US012134164B2

(12) United States Patent
Kasman et al.

(10) Patent No.: US 12,134,164 B2
(45) Date of Patent: Nov. 5, 2024

(54) CHANNEL CUT POLISHING MACHINE

(71) Applicant: UCHICAGO ARGONNE, LLC, Chicago, IL (US)

(72) Inventors: Elina Kasman, Naperville, IL (US); Jonathan Montgomery, Naperville, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 1184 days.

(21) Appl. No.: 16/897,426

(22) Filed: Jun. 10, 2020

(65) Prior Publication Data

US 2020/0368875 A1 Nov. 26, 2020

Related U.S. Application Data

(62) Division of application No. 15/721,568, filed on Sep. 29, 2017, now Pat. No. 10,682,738.

(51) Int. Cl.
*B24B 7/02* (2006.01)
*B24B 1/00* (2006.01)
(Continued)

(52) U.S. Cl.
CPC ..... *B24B 51/00* (2013.01); *B24B 1/00* (2013.01); *B24B 7/02* (2013.01); *B24B 7/075* (2013.01);
(Continued)

(58) Field of Classification Search
CPC .. B24B 1/00; B24B 7/02; B24B 7/075; B24B 27/0015; B24B 27/0038; B24B 27/0046; B24B 37/005; B24B 37/04; B24B 37/042; B24B 37/10; B24B 37/27; B24B 37/30; B24B 37/345; B24B 41/002; B24B 41/005; B24B 41/02; B24B 41/04; B24B 41/047; B24B 41/06; B24B 41/068; B24B 49/04; B24B 49/12; B24B 51/00
(Continued)

(56) References Cited

U.S. PATENT DOCUMENTS 2,869,292 A 1/1959 Ira
3,805,456 A 4/1974 William
(Continued)

FOREIGN PATENT DOCUMENTS

JP 3161863 U * 8/2010 ..... B23Q 39/024

OTHER PUBLICATIONS

E. Kasman, et al. "The best of both worlds: automated CMP polishing of channel-cut monochromators", Proc. SPIE 9590, Advances in Laboratory-based X-Ray Sources, Optics, and Applications IV, 95900D (Sep. 3, 2015); https://doi.org/10.1117/12.2196034.
(Continued)

*Primary Examiner* — Eileen P Morgan
(74) *Attorney, Agent, or Firm* — CHERSKOV FLAYNIK & GURDA, LLC

(57) ABSTRACT

A device for polishing of a multi-surface workpiece is described. The device includes a base and a vertical motion platform that moves along two support rods, which carries a motor that drives a rotating shaft. The support rods extend from said base. A polishing tool is attached to the motor shaft. The workpiece being polished is placed on a linear motion stage during the polishing process.

20 Claims, 11 Drawing Sheets

(51) Int. Cl.

| | |
|---|---|
| ***B24B 7/07*** | (2006.01) |
| ***B24B 37/013*** | (2012.01) |
| ***B24B 37/015*** | (2012.01) |
| ***B24B 37/04*** | (2012.01) |
| ***B24B 37/10*** | (2012.01) |
| ***B24B 37/30*** | (2012.01) |
| ***B24B 37/34*** | (2012.01) |
| ***B24B 41/00*** | (2006.01) |
| ***B24B 41/06*** | (2012.01) |
| ***B24B 49/04*** | (2006.01) |
| ***B24B 49/12*** | (2006.01) |
| ***B24B 51/00*** | (2006.01) |

(52) U.S. Cl.
CPC ..... *B24B 37/013* (2013.01); *B24B 37/015* (2013.01); *B24B 37/04* (2013.01); *B24B 37/042* (2013.01); *B24B 37/34* (2013.01); *B24B 37/345* (2013.01); *B24B 41/00* (2013.01); *B24B 41/005* (2013.01); *B24B 41/068* (2013.01); *B24B 49/04* (2013.01); *B24B 49/12* (2013.01)

(58) Field of Classification Search
USPC ..... 451/5, 9, 10, 11, 41, 54, 150, 212, 213, 451/215, 272, 273, 393
See application file for complete search history.

(56) References Cited

U.S. PATENT DOCUMENTS

| | | | | |
|---|---|---|---|---|
| 4,550,532 | A * | 11/1985 | Fletcher, Jr. | G05B 19/25 451/6 |
| 4,890,420 | A | 1/1990 | Azimi | |
| 5,947,797 | A * | 9/1999 | Buzzetti | B24B 51/00 451/384 |
| 6,190,239 | B1 * | 2/2001 | Buzzetti | B24B 51/00 451/42 |
| 6,637,737 | B1 * | 10/2003 | Beecherl | B23Q 3/18 269/71 |
| 8,403,728 | B2 | 3/2013 | Chen | |
| 10,112,285 | B2 | 10/2018 | Ryoko et al. | |
| 2005/0077188 | A1 * | 4/2005 | Mao | B24B 49/04 205/640 |
| 2013/0165019 | A1 * | 6/2013 | Huang | B24B 37/08 451/5 |
| 2017/0225287 | A1 * | 8/2017 | Murofushi | B24B 37/005 |
| 2018/0099375 | A1 * | 4/2018 | Ando | B24B 41/06 |
| 2020/0086426 | A1 * | 3/2020 | Yamamoto | H01L 21/67092 |
| 2020/0185255 | A1 * | 6/2020 | Murata | H01L 21/6836 |
| 2021/0098316 | A1 * | 4/2021 | Takeishi | B24B 37/10 |
| 2024/0001489 | A1 * | 1/2024 | Zhu | B23K 26/032 |

OTHER PUBLICATIONS

Young, Warren C., and Raymond J. Roark. "Chapter 11: Flat plates" Roark's Formulas for Stress and Strain. 7th ed. New York: McGraw-Hill, 2002. pp. 429-524.

* cited by examiner

CHANNEL CUT POLISHING MACHINE

PRIORITY OF THE INVENTION

This U.S. Patent Application claims priority benefit as a Divisional of U.S. Utility patent application Ser. No. 15/721,568 filed on Sep. 29, 2017, currently pending, the entirety of which is incorporated herein by reference.

CONTRACTUAL ORIGIN OF THE INVENTION

The U.S. Government has rights in this invention pursuant to Contract No. DE-AC02-06CH11357 between the U.S. Department of Energy and UChicago Argonne, LLC, representing Argonne National Laboratory.

BACKGROUND OF THE INVENTION

1. Field of the Invention

This invention is directed to a polishing tool engaged in high precision motion with respect to a work piece and a mount for the polishing tool.

2. Background of the Invention

Scientific and industrial processes frequently require polished components and parts. Irregularities on surfaces of lenses and mirrors, dimples on surfaces of crystals, sides of reaction chambers, and other workpieces, subsurface damage and crystalline strain, can all interfere with component performance. As such, a specialized high precision polishing device and method are described.

In one version of the polishing tool, the object being worked on is mounted on a support platform or base that is placed on a moving stage undergoing linear movement. The object is polished by contacting with a rotating polishing tool. In one embodiment, the polishing tool is shaped like a disk.

An area that especially requires highly polished channel-cut crystals is x-ray light sources, such as those utilizing synchrotron radiation, as well as lab-based x-ray sources like those used for imaging, including medical imaging. By selectively polishing inner walls of a channel-cut crystal, the diffracting inner surfaces retain the perfect crystalline co-alignment of the original monolithic crystal, creating a double-bounce monochromator, without the complication of perfectly aligning a set of matched separate crystals.

Devices to selectively transmit electromagnetic radiation, neutron, and x-ray radiation, are used to evaluate experiments in any number of fields, including physics. A crystal monochromator allows for the selection of neutron or x-ray radiation having a particular wavelength (or energy). However, for each band of wavelength, the monochromator requires at least one crystal, such as germanium or silicon crystals, cut at specific orientation of crystalline planes. Other crystalline materials, such as quartz and sapphire, can also be used, if they meet the crystalline quality specifications, with regards to number of dislocations, slips, voids, or other crystal defects. Only crystals of very high quality can be used for such monochromators, and arrays or slabs of such crystals are required in most applications.

Initial machining of crystalline materials tends to impart subsurface damage that propagates deep into the crystal bulk. Chemical etching is often used to remove the stress and strain left in crystal after the machining steps. However, chemical etching does not result in smooth surfaces, but rather results in dimpled surfaces, what is often called "orange peel." The chemically etched "orange peel" surface causes scattering of the light beam, flux reduction, and can show up as an imprint in imaging applications. Even though x-ray diffraction relies on bulk crystalline properties of the component, these surface issues contaminate the light beam and increase noise in the measurements and data results. Non-crystalline materials used in such channel-cut configurations will suffer similar problems.

Difficulty arises in reaching for surface finishing of all the surfaces of a component with partially obscured surfaces, such as inner walls of channels.

Therefore, a need exists in the art for a device to enable the process of polishing the partially obscured surfaces of channel cut crystals used in monochromators and other crystal-based devices. Similar need exists in surface finishing of partially obscured surfaces of components made from non-crystalline materials.

SUMMARY OF THE INVENTION

An object of the present invention is to provide a polishing system and method that overcomes many of the limitations of the prior art.

A further object of the present invention is to provide a system and method that results in uniformly polished workpieces. A feature of the present invention is that a polishing tool can be used to smooth out the surface of a work piece. An advantage of the present invention is that a clean finished surface of a workpiece can be achieved. An additional advantage of the present invention is that a method can be developed to remove any subsurface damage or strain from the partially obscured surfaces under work.

Another object of the present invention is to provide a system which polishes out the surfaces of a channel cut crystal. A feature of the present invention is that the polishing tools can reach inside any surface of a channel. An advantage of the present invention is that it can be used for polishing inner walls of very narrow channels.

Another object of the present invention is to provide a system and method that can move in any direction in a three-dimensional system. A feature of the present invention is that a software-controlled motor can move the polishing tool to any vertical position and a workpiece stage moves the workpiece in any horizontal direction. An advantage of the present invention is that the workpiece orientation can be adjusted to arrive at any position by moving either the polishing tool or the workpiece.

An additional object of the present invention is to provide a system which polishes surfaces autonomously. A feature of the present invention is that measurements of the current profile of the surfaces to be polished are used to control the location and duration of the polishing. An advantage of the present invention is that the polishing action can be performed without extensive user involvement.

Another object of the present invention is to provide a system which can selectively target a portion of the workpiece for machine-controlled automated polishing. A feature of the present invention is that the device uses computer-controlled and highly precise alignment of the workpiece and polishing tool. An advantage of the present invention is that it can be used to refine only specific sub-portions of workpiece surfaces, unlike prior methods such as acid etching which indiscriminately affect all workpiece surfaces. Further, the device uses much higher precision than manually-operated systems.

A further object of the present invention is to provide channel cut monochromators which have smooth surfaces with no subsurface damage or strain. A feature of one embodiment of the invention is that the polishing tool will result in a highly polished surface on each side of the monochromator. An advantage of the present invention is that the monochromator will not pollute the beam due to a rough, dimpled, or wavy surface.

Another object of the present invention is to provide a system which compensates for disk deflection. A feature of the invention is that the physical performance of the disk is analyzed and any deflection compensated for. An advantage of the present invention is that the performance of the polishing tool can be predicted and analyzed.

A further object of the invention is to provide a fully automated system. A feature of the invention is that the motion of the workpiece and the polishing tool is controlled by only a few moving components, each of which is capable of highly-precise motion. An advantage of the invention is the movement of the workpiece and polishing tool in three dimensions can be controlled and monitored in a feedback-based system.

A further object of the invention is to provide a system capable of monitoring the progress of the polishing steps in real time. A feature of the system is that in one embodiment the system uses a contact-based probe, to intermittently determine the performance of the polishing steps. An advantage of the system is that the duration of the polishing process is optimized to reach a desired surface profile.

An additional object of the system is to also enable contact-less measurements to monitor the polishing steps. A feature of the system is that a contact-less progress measurements can be integrated into the system. An advantage of the system is that different measurement tools can be accommodated within the system.

A further object of the system is to provide different polishing tools for different workpieces. A feature of the system is that the polishing tools are interchangeable with little to no tooling. An advantage of the system is that it allows for polishing of any workpiece using a similar approach.

Briefly, the present invention provides a device for polishing of a multi-surface workpiece, the device comprising a base; a vertical motion platform having a weight guide; a motor disposed on the vertical motion platform, wherein said motor drives a rotating shaft; two rods extending perpendicular from said base, wherein the rods support the vertical motion platform while it moves in a direction parallel to the base; free weights attached to the weight guide, wherein said weights ensure equal distribution of weight around the motor shaft; a polishing tool attached to said rotating shaft, wherein surfaces of said workpiece are in contact with said polishing tool; and an alignment and a linear motion stage 28 having a support base plate 27; wherein said alignment and linear motion stage 28 moves in any direction parallel to the base and vertical motion platform, and wherein said alignment and linear motion stage is disposed below the floating platform and wherein the workpiece is reversibly attached to the alignment and linear motion stage 28 support base plate 27.

Additionally a method of polishing of a workpiece is described comprising placing the workpiece on a tray; reversibly attaching the workpiece to the tray using an adhesive; wherein said tray is attached to a support base and wherein said support base is in turn attached to an alignment and a linear motion stage 28 wherein the alignment and linear motion stage is capable of moving to in any horizontal direction; installing a polishing pad on a polishing tool; attaching the polishing tool on a rotating shaft; attaching the rotating shaft to a motor installed on a vertical motion platform; wherein said vertical motion platform is disposed above the workpiece reversibly attached to the tray; beginning the rotation of the polishing tool; lowering the polishing tool to the workpiece; contacting the rotating polishing pad with workpiece surfaces; moving the linear motion stage and the vertical motion platform to polish each region of the workpiece; detecting the surface profile of the workpiece; ceasing the rotation of the polishing pad upon detection of a smooth surface on the workpiece; raising of the vertical platform and the polishing tool; and removing of the workpiece.

BRIEF DESCRIPTION OF THE DRAWINGS

The invention together with the above and other objects and advantages will be best understood from the following detailed description of the preferred embodiment of the invention shown in the accompanying drawings, wherein.

and

Figure 9:
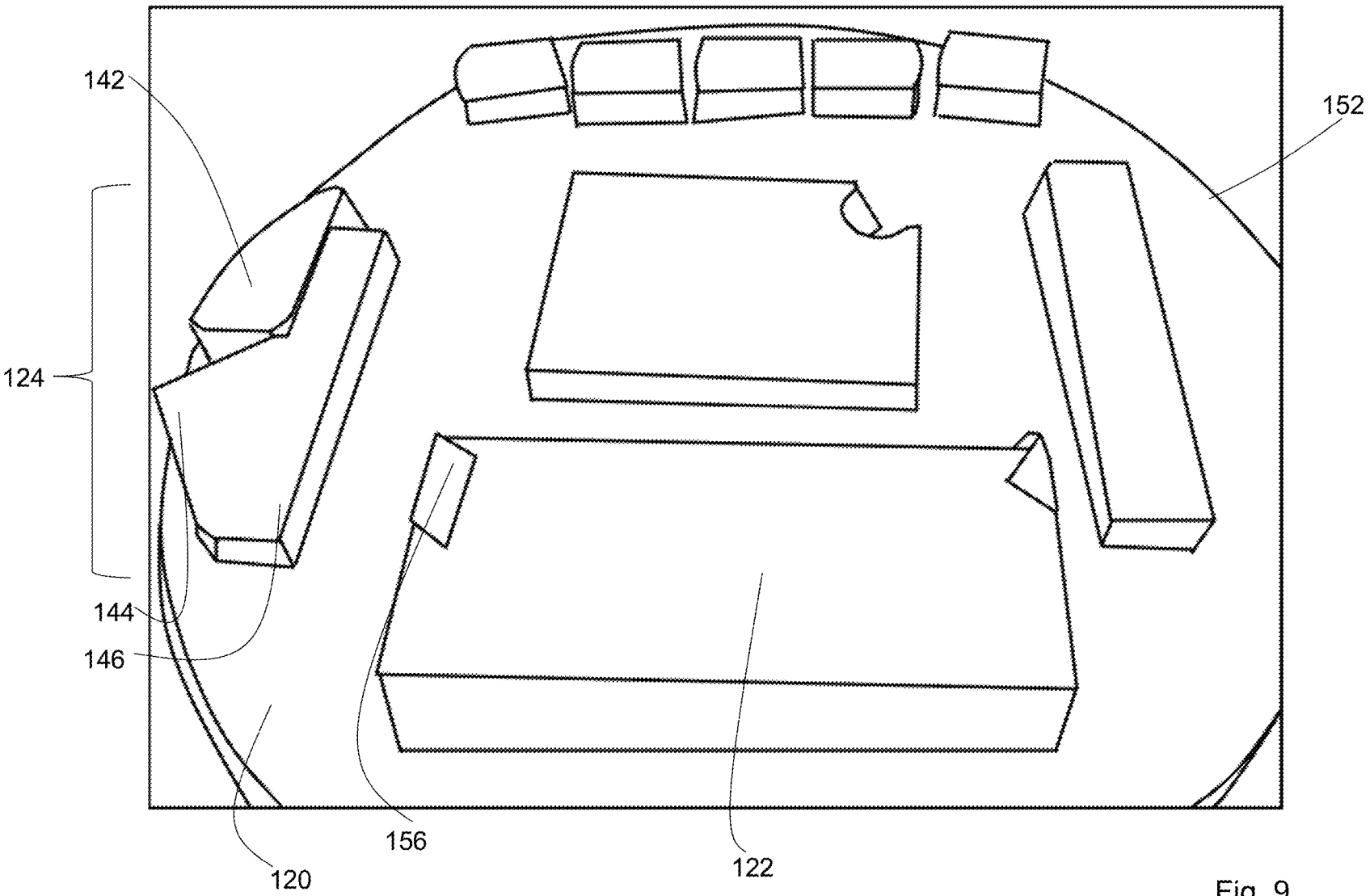

FIG. 9 shows another view of a workspace arrangement of one embodiment of the invention.

DETAILED DESCRIPTION OF THE INVENTION

The foregoing summary, as well as the following detailed description of certain embodiments of the present invention, will be better understood when read in conjunction with the appended drawings.

As used herein, an element step recited in the singular and preceded with the word "a" or "an" should be understood as not excluding plural said elements or steps, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Overview

Figure 1:
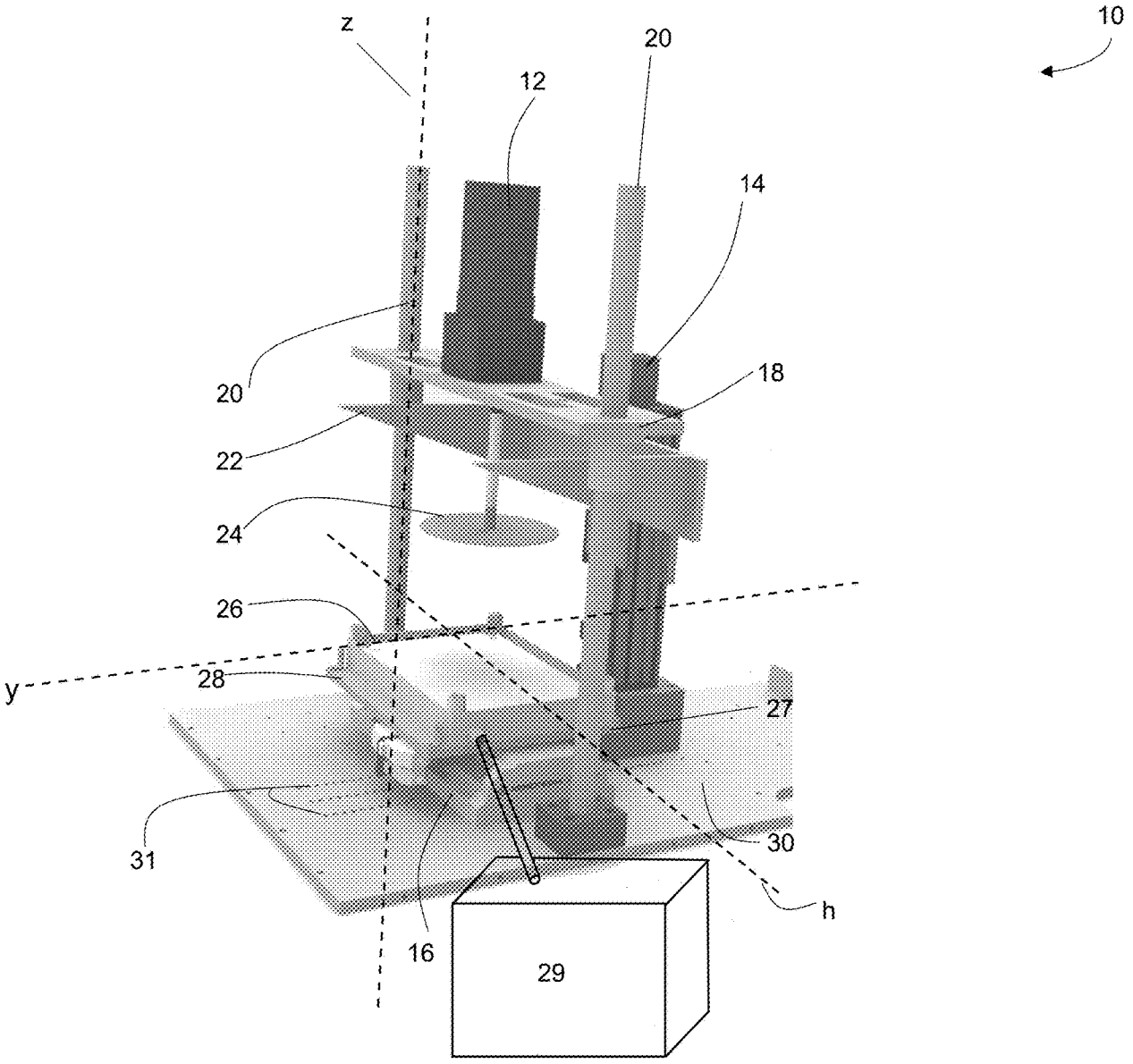
FIG. 1 is an overview of one embodiment of the present invention.

Turning to FIG. 1, it depicts an overview of the system 10 in a drawing of an embodiment.

The device 10 comprises a base substrate 30 with a pair of mounting rods 20 extending in a perpendicular direction (i.e., along the vertical z axis) from the base substrate 30. The mounting rods 20 are shown with a line h (designating the horizontal axis) passing through the middle of each rod. In one embodiment, the base substrate 30 also includes several accessory apertures 31 to allow for reversible attachment of the device 10 to a table (for example by passing bolts through the apertures 31). The apertures 31 also allow for addition of accessories to the device 10, such as building an enclosure around the device 10 (not shown) or to reversibly attach a slurry waste container (shown as element 29).

A platform 18 traverses the length of the mounting rods 20 and is capable of movement along the length of the rods 20. The platform can accept a number of additional elements, including a designated location for a rotary motor 12. In one embodiment, the platform 18 also includes apertures where free weights (not shown) may be placed to add stability and/or polishing force to the device 10. The platform 18 is carried along stainless steel ball bearings, in one embodiment and its position along the mounting rods 20 is controlled using a high precision motor 14 and accompanying sensor. The platform 18 moves along the length of the mounting rods 20 a speed of 100 millimeters per second, in one embodiment.

The rotary motor 12 includes a hardened steel worm-drive shaft and a forged bronze gear, which in turn spins the polishing tool 24. In one embodiment the motor spins the polishing tool 24. The motor provides the necessary torque to sustain polishing friction for an extended period of time without overheating or stalling. The motor 12 shaft drives the polishing tool directly, without any gearboxes, belts, or other rotational force redirection mechanisms, in one embodiment. In another embodiment, the motor assembly uses a parallel offset gearbox to allow minor vertical play in the shaft, and therefore the movement does not jam the motor, a parallel gear box in this embodiment provides better weight distribution (symmetry) for the platform 18.

The platform 18 is moved along the mounting rods 20 through the motion of the custom lifting fork 22. As shown in the embodiment of FIG. 1, the lifting fork 22 comprises two arms with a substantially triangular shape. This shape allows the lifting fork 22 to distribute the weight of the platform 18 evenly without obscuring access to the work area below the platform 18.

As depicted in FIG. 1, one embodiment of the polishing tool 24 comprises a disk having polishing surfaces on only one side of the polishing disk. In another embodiment, both sides of the disk include an abrasive surface. The polishing tool 24 comprises a polishing disk and a swivel head, which will be discussed below.

The work area is defined by a raised edge tray 26. During the polishing process, a cooling and dust reducing abrasive slurry or polishing liquid (described below) is introduced by the system. The raised edge tray 26 is used as a means to contain the output from the polishing process. The raised edge tray 26 also allows for precise alignment of the crystal being worked on.

While the crystal being worked on is fixed in the raised edge tray 26, the tray 26 is mounted on the alignment stage 28 which moves in the horizontal directions, and has angular alignment, in one embodiment. The alignment stage 28 includes a linear movement motor 16, in one embodiment.

As can be appreciated from the embodiment depicted in FIG. 1, any surface of the workpiece being polished by the system 10 is contactable by the polishing tool 24 as the polishing tool has freedom of movement. The polishing tool 24 moves in the vertical direction (z-axis) through the movement of the platform 18, whose movement is controlled by the high precision motor 14. The raised edge tray 26, to which the workpiece is removably mounted, moves through as well as parallel to both horizontal axes h and y and the vertical axis z between the parallel mounting rods 20. The movement of the edge tray 26 originates with the alignment stage 28 which is coupled to a linear movement motor 16. In this way, the raised edge tray 26 can move in any horizontal direction, (i.e., along the x-axis or z-axis) while the polishing tool 24 can move in any vertical configuration.

While the polishing tool 24 is shown as a disk in FIG. 1, other shapes are used in other embodiments. In one embodiment, the polishing tool 24 has protrusions for polishing in the shape of a gear. In other embodiment, the polishing tool 24 has a central nucleus where it attaches to the motor spindle and multiple arms protruding from the central nucleus. In this embodiment, each arm has a different polishing performance and can be raised or lowered to engage the surface selectively.

Channel Cut Crystal Detail

Figure 2:
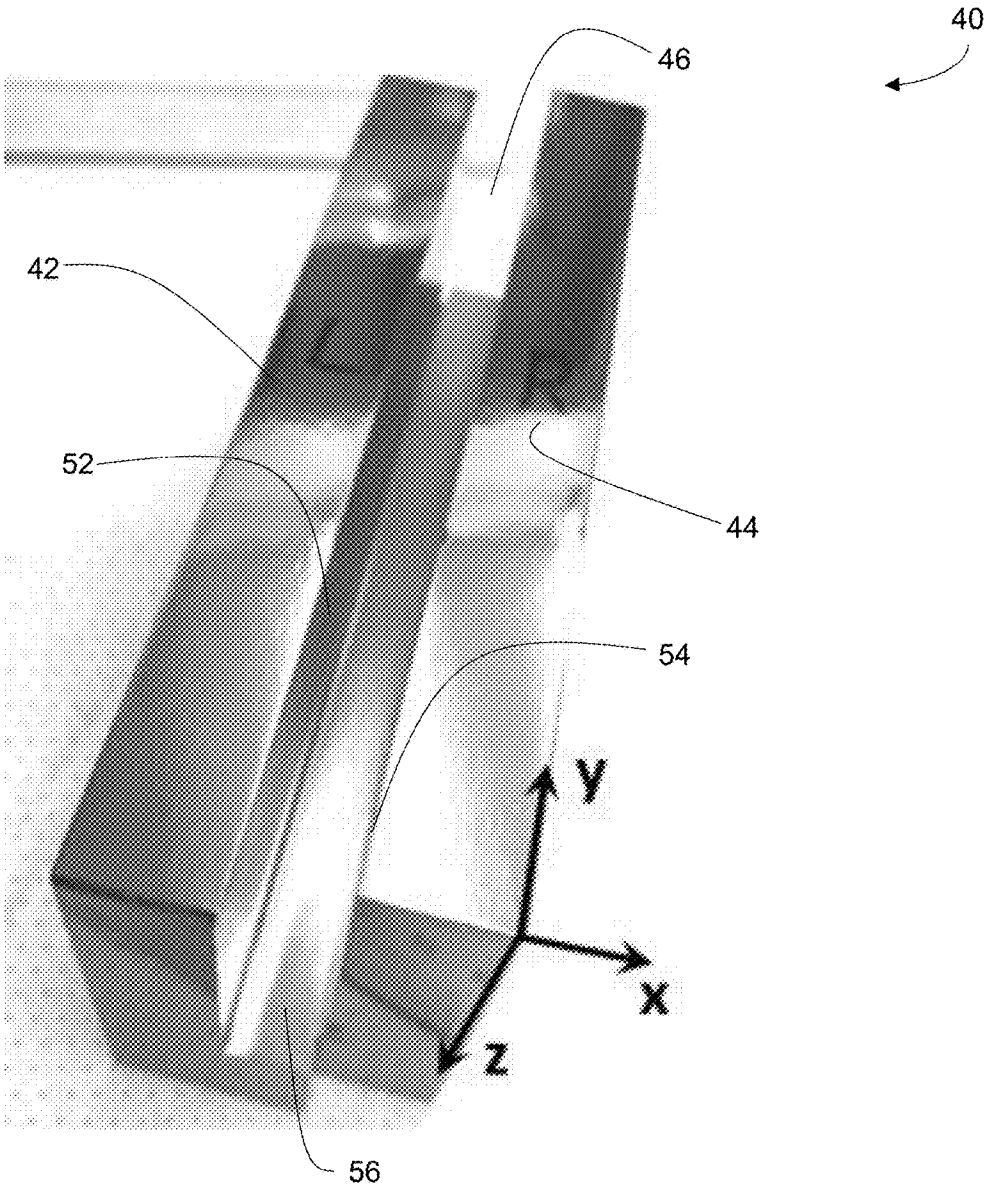
FIG. 2 is an overview of one crystal to be polished using an embodiment of the present invention.

A channel-cut crystal 40 is depicted in FIG. 2. The crystal 40 can comprise any material appropriate to an X-Ray or other high energy source, however in some embodiment silicon or germanium crystal is used in conjunction with the system. In some embodiment, other, non-crystalline, material could be used as workpiece in the system in such a way as to polish a partially obscured surface to desired surface finish and flatness, while maintaining the monolithic structure of the component under work.

The channel-cut crystal 40 comprises a left 42 and a right 44 span. The spans 42, 44 are separated by a channel 46. As the channel 46 is cut into a single crystal 40, the lattice make up of each span 42, 44 is guaranteed to be identical.

As the channel 46 is made using a conventional cutting technique, the channel 46 has a substantially rectangular shape, as shown in FIG. 2, with a left interior wall 52, right interior wall 54, and bottom interior wall 56. However, after the cut is made, the channel 46, and the walls 52, 54, and 56 are uneven. In conventional treatments, the interior walls 52, 54, and 56 are etched using an acid. However, this process results in walls having dimpled "orange peel" profile which makes them unsuitable for beams having a high coherence. To prevent scattering, preserve the high coherence, and ensure the reflected beams can be used in imaging systems, the interior walls 52, 54, and 56 must be polished to create a flat and strain-free surface.

The polishing tool 24 shown in FIG. 1 smooths out the profiles of interior walls 52, 54, and 56 as the tool 24 moves with respect to the crystal 40 installed on the raised edge tray 26. The details of the tool 24 will be discussed in conjunction with FIG. 3 described below.

Polishing Tool Details

The polishing tool 24 comprises a polishing disk 62, and a spindle assembly 64. The disk 62 includes a first disk region 66, and a second disk region 68. In one embodiment, different polishing pads (not shown) are attached to the second disk region 68, in another embodiment polishing disks with different physical properties are used depending on the required smoothing action.

The polishing tool 24 components are designed to be removably attached. Polishing pads (not shown) and other abrasive substrates are removably attached to the bottom surface 74 of the polishing tool 24.

The polishing pads are selected to match the geometry of the polishing tool, such as the channel 46 depicted in FIG. 2.

Thus polishing disks 62 of various physical properties can be readily attached to the spindle assembly 64, including disks 62 of various thickness, disk radius, material, and size of area which performs the active polishing.

The polishing disk 62 comprises a thin substrate and it is prone to deformation during rotation and while contacting one of the crystal 40 side walls 52, 54, 56. Any deformation would result in imperfections in the final crystal surfaces. Thus, the system includes a method to minimize disk 62 deformation, using a combination of optimizing the geometry and rigidity of the disk 62.

The process of optimizing rigidity is iterative. First, a thickness of the disk, and a radius is chosen depending on the profile of the crystal 40 to be processed. Second, presuming an infinite polishing time interval, the maximum deformation is calculated. This maximum deformation provides the worst case scenario for the uneven profile of the crystal surfaces. While the deformation may cause the crystal 40 surfaces 52, 54, 56 to have imperfections, the disk 62 will not bind to the surface 52, 54, 56 being worked on, due to the design of the system.

Following the calculation of the worst theoretical performance of a given disk 62, the actual likely performance is evaluated. This is performed using Roark's Formulas for Stress and Strain for a circular plate uniformly loaded in the center spindle assembly 64.

Figure 3:
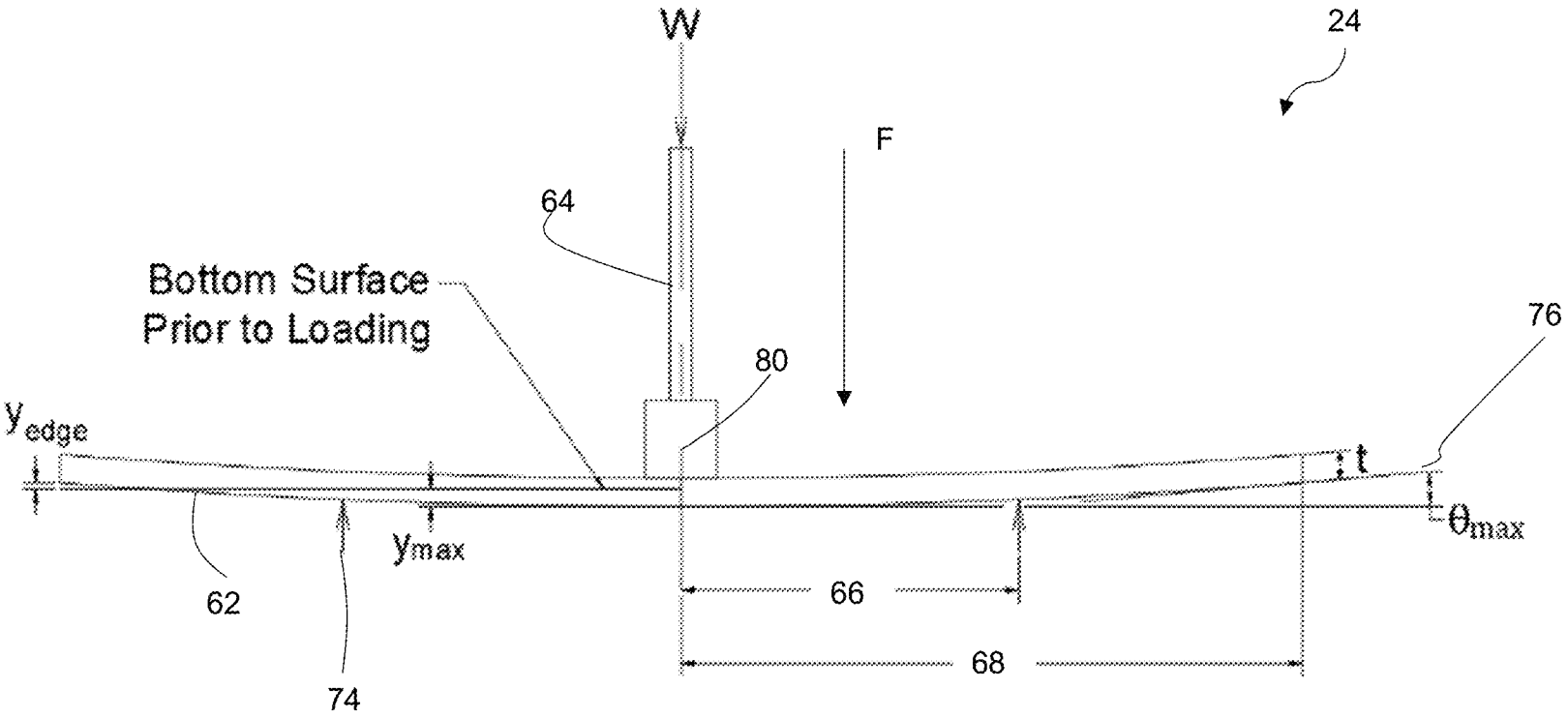
FIG. 3 depict an overview of the polishing tool, pursuant to one embodiment of the invention.

In one calculation the maximum center deflection and the maximum edge slope are calculated. As shown in FIG. 3, the maximum center deflection is the value $y_{max}$ while the edge slope value is $\theta_{max}$:

$$y_{\max} = \frac{-Wa^2(3+v)}{16\pi D(1+v)}$$

$$\theta_{\max} = \frac{Wa}{4\pi D(1+v)}$$

In the above equations, v represents the Poisson's ratio (a function of the physical makeup of the polishing disk 24). W is the amount of force supplied by the system 10 on the polishing disk 24 center spindle 64. D is the flexural rigidity of the system, described by the following equation:

$$D = \frac{Et^3}{12(1-v^2)}$$

In this equation, E is the elastic modulus for the material as described by Young's modulus. The value t is the amount of displacement observed as shown in FIG. 3.

The above equations presume that the polishing tool 24 is a circular plate that is uniformly loaded in the center. The polishing tool disk 62 is flat, of uniform thickness, and of homogenous isotropic material. The thickness of the plate is no more than ⅓ of the smallest transverse dimensions. Further, the tool 24 does not experience forces (loads and reactions) that are not normal to the plane of the disk 62 and the tool 24 is not stressed beyond its elastic limit. The setup of the system 10 ensures that these presumptions are substantially met during operation of the system 10.

As shown in FIG. 3, the maximum center deflection occurs along the center axis, while the maximum slope occurs at a distance 66 closer to the edge away from the center axis.

In the mathematical model, the edges 76 of the disk 62 are supported. However, in the implemented system 10, the edges 76 must extend beyond the support. This results in a bending moment created by a portion of the disc cantilevering beyond the support point at the edge of the crystal. The resulting bending moment from the cantilever is negligible so long as the ratio of the force from the weight of the cantilevered disk relative to the downward force W pressing down on the central part of the disk is high. However, the disk edge 76 also will deflect in the vertical direction, pursuant to:

$$y_{edge}=(R-a)\tan(\theta_{max})$$

In the above formula, R is the distance 68 from the center of the disk 62, a is the distance 66, where the maximum slope begins.

Given the above relationships, it is possible to calculate the maximum vertical deflection for both aluminum and 304 stainless steel. These are two common materials available for rapid manufacturing, using fixed dimensions.

A material with higher rigidity will minimize disk 62 deflection. In one embodiment the polishing tool 24 was designed to maximum thickness that comfortably fits inside the crystal channel width. Tool thickness must also accommodate for the thickness of the polishing and cushioning pads mounted on the bottom 74 and top surfaces of the disk 62.

Outriggers (shown in FIGS. 8 and 9 discussed below) are also added to the tray 26 during the polishing steps. Outriggers are selected to be of the same height as the crystal surface being polished. The collective top surface of all the outriggers combined creates the plane upon which the polishing tool rides, defining the resulting flatness of the polished crystal diffractive surface. By adjusting the relative height of outriggers positioned around the inner surface of channel cut crystal, the parallelism and wedge of diffracting surfaces can be slightly corrected.

The polishing tool 24 has a swivel joint connection 80. The swivel joint connection 80 allows the tool 24 to perform angular correction adjustments, allowing the disk 62 to fully mate with the collective top surface of the outriggers and the slotted crystal combined.

Use Detail

The custom floating platform 18 moves up and down on the vertical stainless shafts with linear bearings 20. The platform 18 is lifted up and down using a custom lifting fork 22 attached to the vertical movement column 14. Disk-shaped polishing tools 24 are made from aluminum or steel to match the geometry of each crystal being polished. The polishing tool 24 is affixed to the swivel head 80, which in turn is connected to the motor shaft 64. A keyed shaft coupler ensures a rigid transfer of rotational speed regardless of the friction between the tool and crystal during polishing.

In order to replace the polishing tool 24 in-between steps, or for reconditioning, the platform 18 is lifted out of the way using the vertical movement fork 22. A raised edge tray 26 contains the sludge slurry resulting from the polishing steps and drains the waste into a collection system such as a waste container 29.

The alignment and linear motion stage 28 allows for both a theta alignment and fine adjustment of position in the Y-direction. This fine adjustment is necessary to ensure that the bottom of the crystal channel moves parallel to the edge of the polishing tool, and as close to full depth as possible. The goal is to achieve an exclusion area no wider than a millimeter, maximizing the clear aperture of the polished surfaces. The motion of the alignment and linear motion stage is controlled independently of the motion of the vertical motion platform.

The channel-cut crystal being worked on rests on mounting block (in one case, ceramic) that sits inside the tray 26, surrounded by outriggers chosen to match the crystal's channel wall thickness. The outriggers and the channel-cut component are mounted with a thermoplastic adhesive to a ceramic block which is then securely clamped into the raised edge tray 26. Additional supporting blocks are necessary for channel-cut crystals with bottom mounting flanges.

In one embodiment, the motor 12 is a Bison Gear AC rotary motor. The vertical movement uses a bi-slide linear stage driven by a stepper motor and controller. Rotation speed is set by a controller such as the VXM controller. Movement of the raised edge tray 26 is accomplished by a linear stage motor such as the Aerotech ECO-165LM.

The vertical movement motor is controlled via a one axis programmable stepper motor controller, capable of continuous and jog motions at set step sizes. USB to RS232 serial communication port allows for integration with automated control systems. The Rotary motor is operated via an on/off switch on the motor power cord, in one embodiment, with another embodiment using a remotely controllable relay. Linear motion of the horizontal raised edge tray 26 is driven by the Aerotech Soloist module controlled by interface application integration software. All three of these systems are combined into a monolithic control system using a single platform for rapid connectivity in a single software backbone, such as LabVIEW, in one embodiment.

In some embodiments, free weights are added to the top of the platform 18, shown in FIG. 1, to provide the attached polishing tool 24 with additional down force W. The free weights, which can take the form of coated metal discs, provide additional down-force F on the polishing tool 24 as it is rotating. This force is translated to the crystal via the spindle assembly 64, creating uneven pressure distribution. This uneven distribution is compensated with the addition of sacrificial outrigger crystals during the polishing process to support the tool away from the active surface.

In the depicted embodiment, the system is capable of highly precise movements in all three axis (horizontal h, vertical z, and depth y). However, as the channel-cut crystal has a substantially rectangular profile, complicated numerically controlled movements are not required to plan the motion of the polishing tool. In another embodiment, designed to polish objects having irregular geometries, the system is programmed to optimize the path of the polishing tool to avoid overly reducing the surface of any one area or wasting time re-polishing a portion of the object previously visited.

Surface Profile Measurements

Measuring the amount of polishing that is required ensures that the system can operate autonomously. In one embodiment, during the polishing of the crystal 40 surfaces 52, 56, 54, a contact rod is used. The polishing process continues in a particular location so long as the contact rod reports that material remains to be removed in a given area.

In another embodiment, the surface profile is intermittently evaluated using non-contact measurement means. In this embodiment, a surface profile topographical map is generated at the start of number of passes, the polishing tool performs a pass or passes, and then another topographical map is performed. The iterative process results in creating a database of information which considers not only the current state of the channel profile, but also the simulated polished version, and finally the actual polished version. In one embodiment, the images are also provided to a self-learning algorithm that provides suggestions to the system operator as what polishing pads should be used and the duration of use of each polishing step.

The linear motion stage can be programmed to move at varying speeds, and to dwell on certain area of the workpiece longer than in other areas. This compensates for the non-uniformity of the polishing process that results from non-uniform linear speeds of the tool as it moves across the workpiece during the polishing process.

Slurry Delivery

Slurry delivery is an important aspect of the system 10. If slurry starvation occurs during the polishing process, the polishing has to be interrupted and the slurry replenished.

Further, a lack of slurry results in uneven wear on pad surfaces and requires frequent pad cleanings and pad reconditioning. Improved slurry delivery, in one embodiment via designated slurry delivery channels, ensures higher overall efficiency of the polishing steps and less human involvement during the process.

Results

Figure 4A:
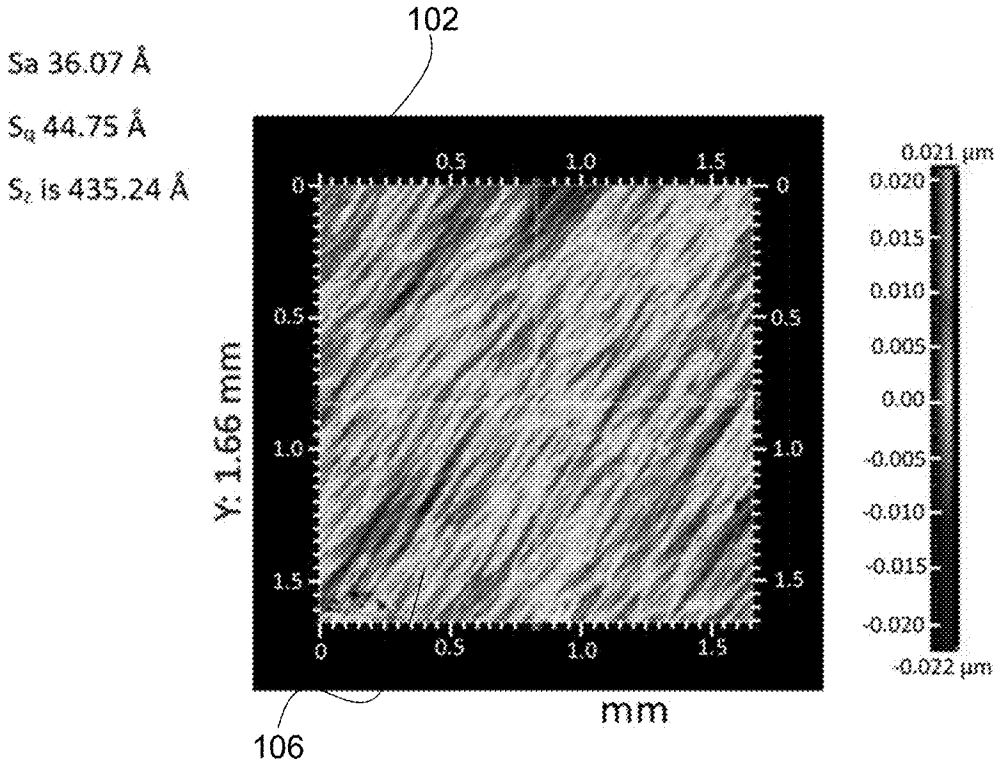
FIG. 4A depicts a topographical map of surface roughness measurement of the output of the polishing system, pursuant to one embodiment of the invention; compared with FIG. 4B surface roughness measurement from conventional polishing performed on identical material and measured with same method.
Figure 4B:
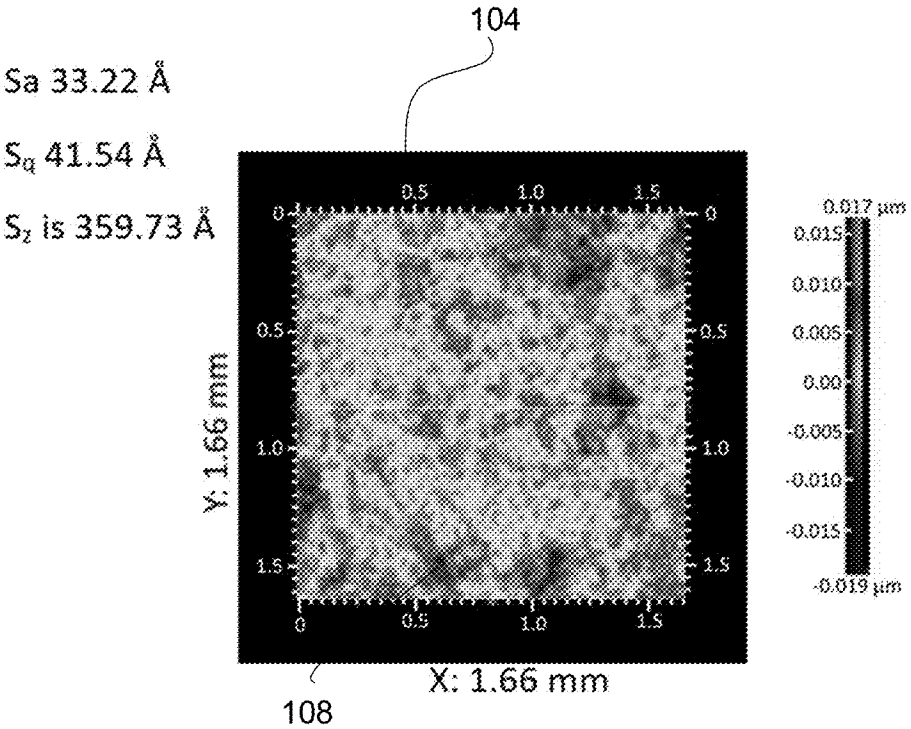

FIGS. 4A and 4B, depict crystal samples 102, 104, having surface profiles 106, 108. Each surface profile 106, 108 is evaluated by measuring roughness and flatness. Both values have a direct effect on beam scattering, especially at low incidence angles, as well as, affecting the preservation of coherence in more sensitive applications. Beam distortions could result from the subsurface damage remaining after machining steps, and crystal strain remaining after various lapping and polishing steps. White beam topography and contrast feature studies are used as a visual qualifier.

The incoming bulk crystal quality is known to be "perfect" without dislocations, slips, voids, or other crystalline defects, any contrast or features in topography images indicate subsurface damage or strain resulting from machining or lapping steps that were not removed in the polishing step. Normally, in a well-balanced and properly designed finishing process, each subsequent fabrication step will completely remove any damage remaining from the preceding machining or abrasive step. Subsequent abrasive processing step introduces its own subsurface damage and strain, which, under normal circumstances, should be significantly lower than the previously present damage. If the polishing step is not well balanced, additional scratches or defects might be introduced. These defects will be reflected on either or both roughness and topography images, such as FIG. 4 or 5, indicating that further process development and adjustment is necessary.

The surface roughness achieved using the system 10 was compared with typical results after similar process using conventional plano polishing tools. For the system 10 results, the equivalent measurements were taken from crystal outriggers, due to the physical inaccessibility of the internal diffracting surfaces. Directional surface features, aligned with the rotation of the tool, are clearly visible surface 106 in FIG. 4A, the result of the system 10. This means mechanical and chemical components of the final chemo-mechanical polishing (CMP) step were not well balanced.

To prevent such a surface profile 106, the kinematics of rotation vs. linear motion, and dwell times, as well as concentration of polishing slurry are adjusted, in one embodiment. In another embodiment, an intermediate pre-polishing step using finer abrasive slurry to minimize surface and subsurface damage after the planarization lapping abrasive step, potentially shortening the overall final polishing time and thus reducing the effect of the chemo-mechanical imbalance.

As shown in FIG. 4A, the roughness of the surface treated by the system 10 is different from the surface 108 of a conventional treatment. The average and RMS roughness numbers, Sa and $S_q$ are comparable, and the polished surface 106 shows directional surface features aligned with the rotation of the tool.

For the system 10 treated surface 106 the values are Sa 36.07 Å, $S_q$ 44.75 Å, and $S_z$ is 435.24 Å. For the conventional treatment surface 108 are Sa 33.22 Å, $S_q$ 41.54 Å, and $S_z$ is 359.73 Å. The size of the each sample 102, 104 was square 1.66 mm on each side. These results show good agreement between conventional plano crystal polishing process and the polishing process of this invention.

Figure 5A:
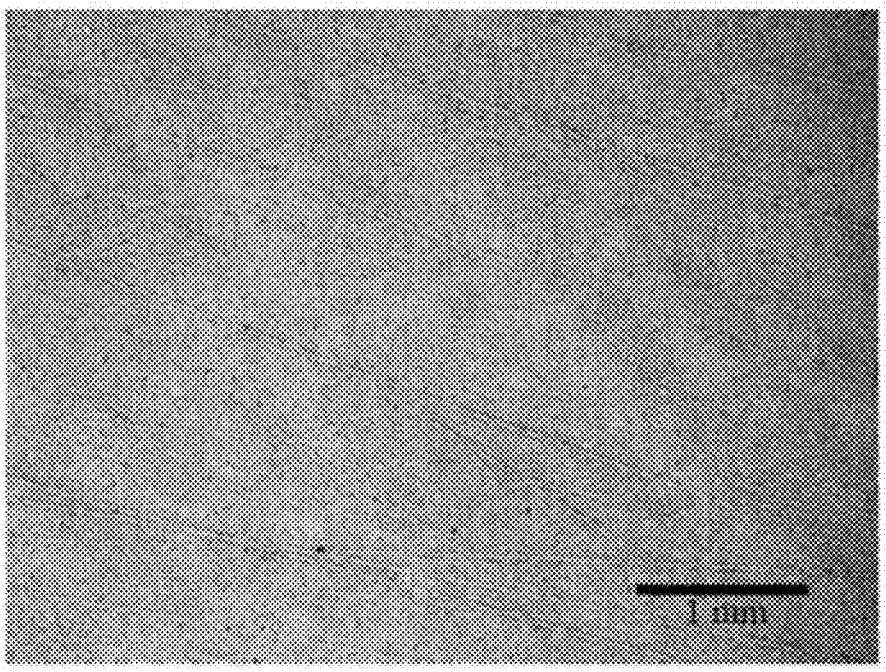
FIGS. 5A and 5B is depiction of x-ray white beam topography of single crystal silicon surface treated by an embodiment of the invention, showing some minimal contrast.
Figure 5B:
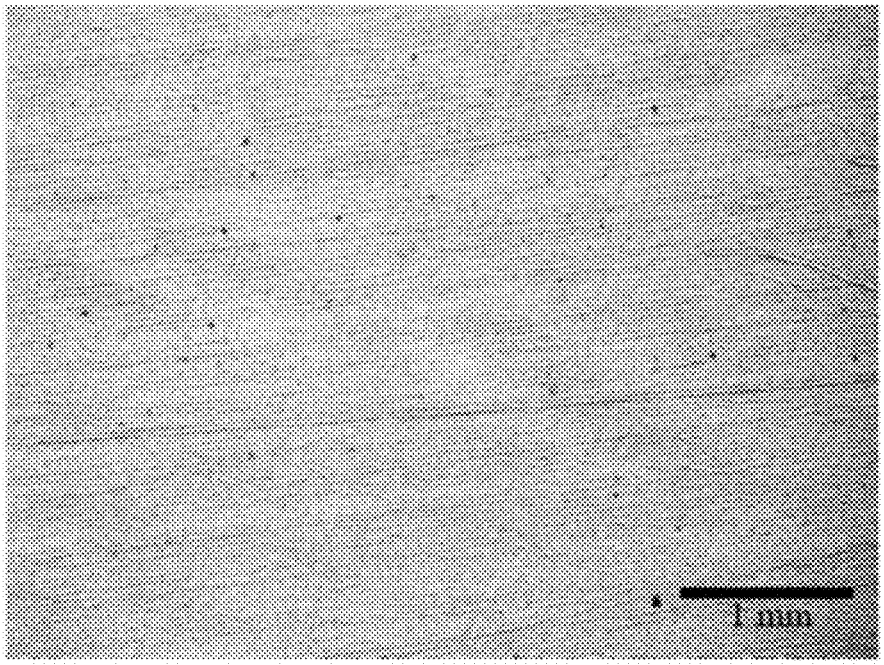

FIGS. 5A and 5B depict white beam topography carried out at 1-BM beamline of APS. A synchrotron white-beam topography of surfaces 112, 114 was carried out at the APS bending-magnet beamline 1-BM in the reflection geometry with the incidence angle being around 5 degrees. The Bragg reflection of the selected Laue spot is −13-1 with diffraction X-ray wavelength being around 0.57 angstroms (E=21.7 keV). Contrast features captured in topography images in FIG. 5 correspond to subsurface damage remaining after the polishing process. Both polished channel cut crystals performed sufficiently well when deployed at their respective beamlines. This demonstrates that despite the need for further polishing process development, current embodiment of the invention is capable of producing functional channel-cut crystals for synchrotron applications. Other applications may not have as stringent surface and strain-free crystal requirements.

Figure 6:
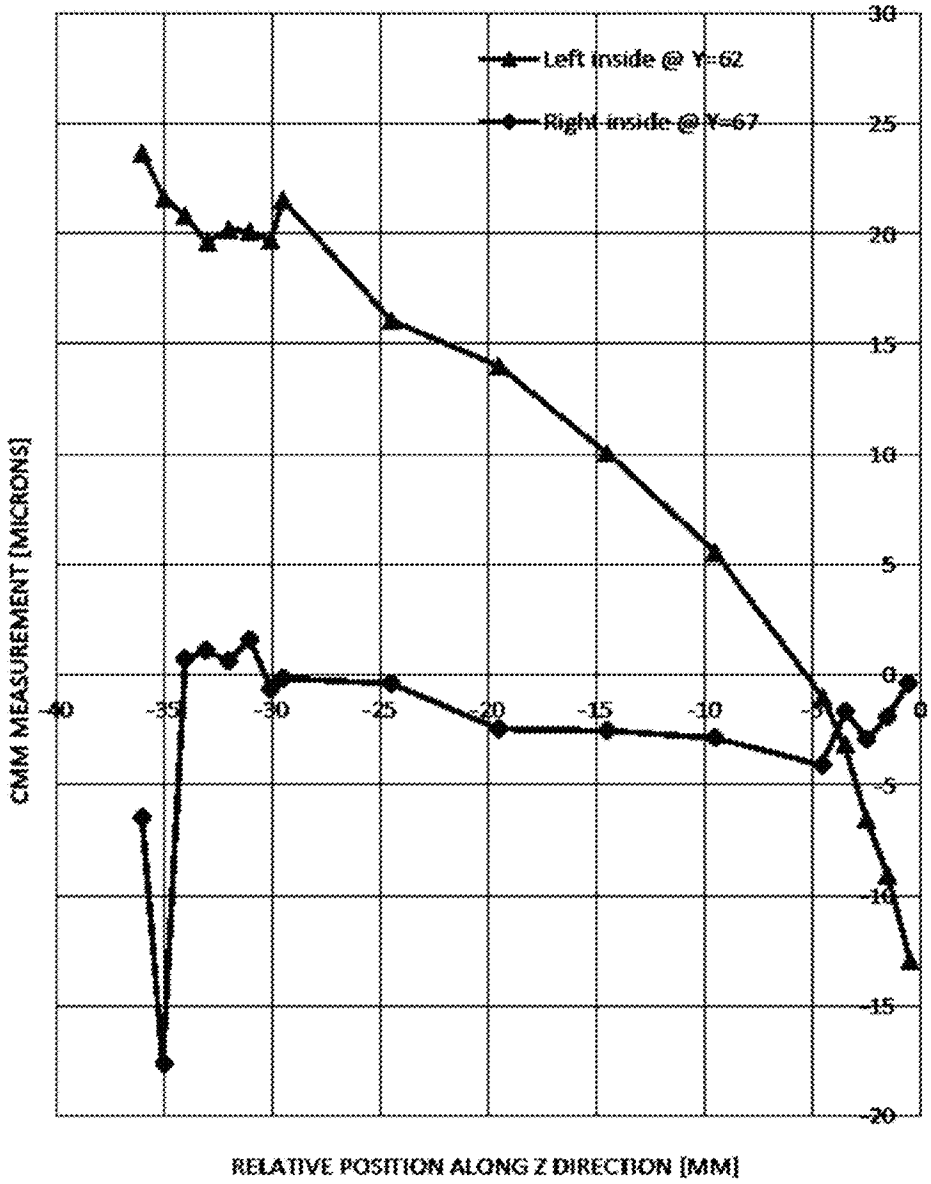
FIG. 6 depicts measurements of inner channel surfaces of crystal before it was treated with the invention; measurement is taken as line points from outside of the channel wall into the depth of the channel, showing relative wedge between channel walls, which needs to be treated with the invention.
Figure 7:
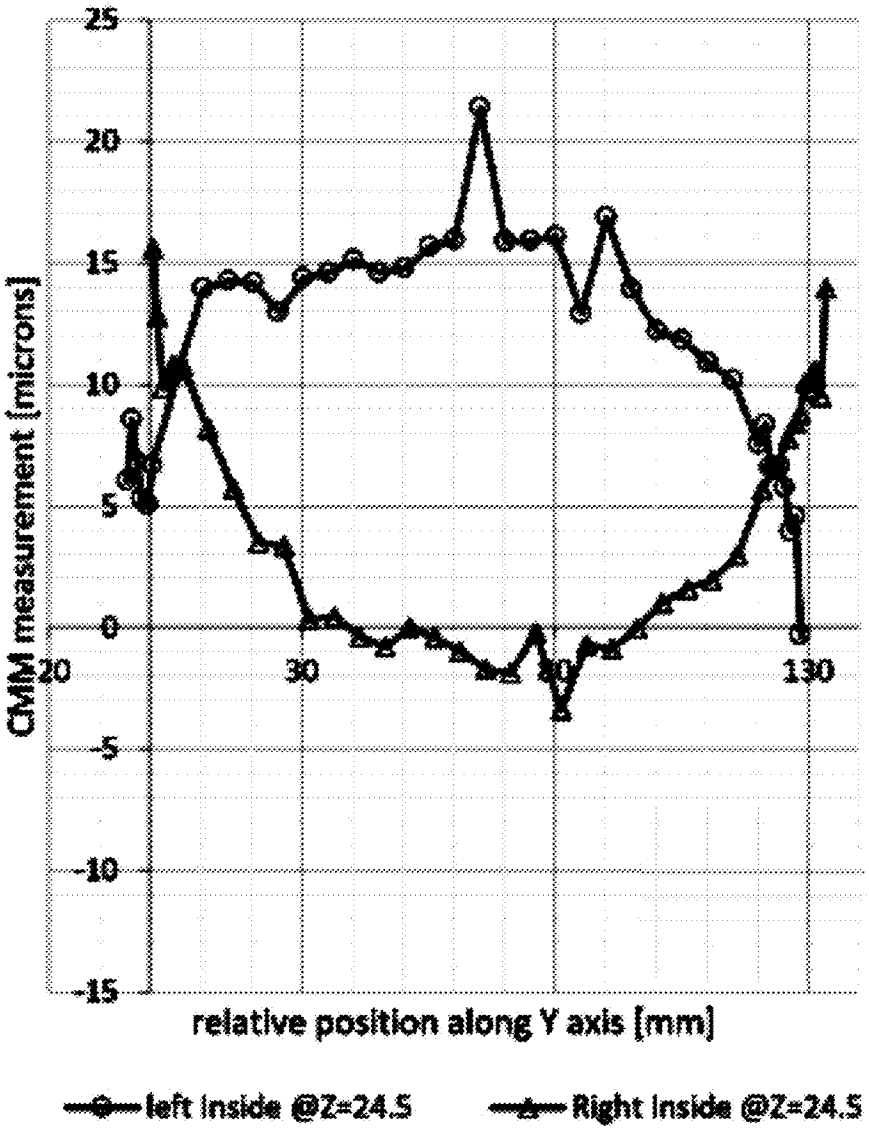
FIG. 7 depicts another measurement of inner channel surfaces prior to being treated with the invention, this time along the channel length, showing both walls are not flat, of concave shape, and need to be treated with the invention to achieve desired flatness.

FIGS. 6 and 7 depicts the extent of parallelism and flatness of inner surfaces of the crystals. Parallelism of inner surfaces becomes increasingly important for multi-bounce applications. One such example is a long and deep crystal, where a manual polishing attempt has been previously unsuccessful. Measurements of inner surfaces of the deep slotted crystal are shown in FIG. 6. As shown in FIG. 6, there is an obvious wedge between the Left and Right side of the inner slotted crystal walls, as well as, a concave shape to both surfaces FIG.7, remaining after previous manual polishing attempts. The wedge can be corrected by selecting the outriggers placed opposite the bottom of the channel to be slightly taller than the side wall thickness, swiveling the polishing tool downward so that it takes material off more aggressively towards the bottom of the channel. The flatness can be corrected by processing using the invention with choosing appropriate geometry for the polishing tool, based on calculations for disk tool deformation as described above.

Tray Arrangement

Figure 8:
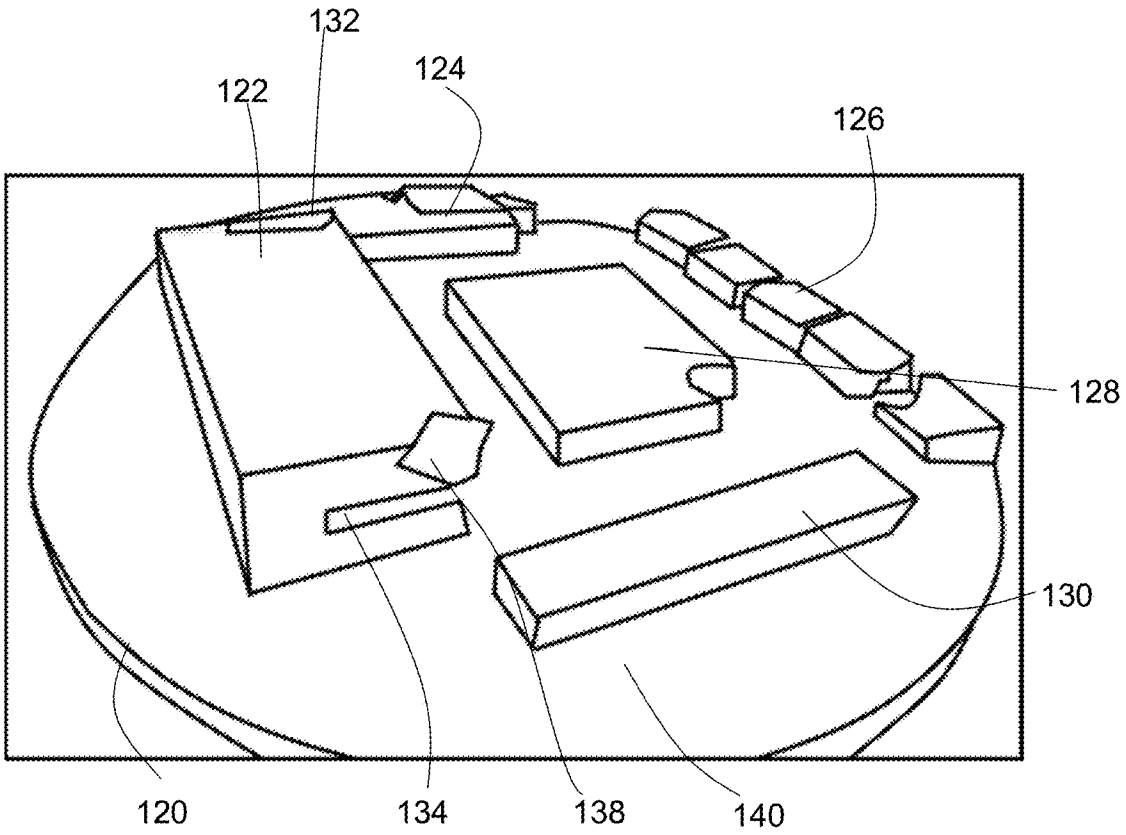
FIG. 8 shows the workspace arrangement of one embodiment of the invention.

As shown in FIGS. 8 and 9, in one embodiment the workpiece stage 120 for holding a crystal 122 will be substantially circular. The stage 120 moves in an arbitrary location in the horizontal x-y plane using a linear movement motor, discussed above.

The stage 120 includes a flat surface to which the channel-cut crystal 122 is reversibly attached. Along with the channel cut crystal 122, the stage 120 includes outriggers, such as the first set of outriggers 124. In the embodiment shown in FIG. 8, the outriggers form three sets on the periphery of the stage 120. The first set 124 comprises multiple outriggers, the second set 126 comprises five substantially rectangular outriggers, while the third set 130 comprises one elongated outrigger. One central outrigger 128 is also present in the embodiment shown in FIG. 8.

The outriggers 124, 126, 128, and 130 support the polishing tool while the polishing tool is buffering one of the surfaces of the channel cut crystal 122. The channel cut crystal 122 includes a channel 134. The height of the outriggers 124, 126, 128, and 130 is designed to correspond to the height of the channel 134.

The channel-cut crystal 122 includes removable tape 138, 132 placed on the corners of the crystal to prevent chipping or other damage should the polishing tool contact the respective corner of the crystal 122.

During operation of the system the workpiece stage 120 directs and collects the slurry 140 from the channel-cut crystal 122.

FIG. 9 shows another view of the workpiece stage 120 showing the three 142, 144, 146 outriggers comprising the first set 124 of outriggers. The three outriggers 142, 144, and 146 provide support in three different areas while the polishing tool is rotating near the first end 156 of the channel-cut crystal 122.

FIG. 9 also shows the outside boundary 152 of the workpiece stage 120. In this embodiment, the boundary is substantially rectangular and does not include a raised edge.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

An exclusive property right or privilege is claimed in the invention as defined by the following claims:

1. A method of polishing of a workpiece comprising:
placing the workpiece on a tray;
removably mounting the workpiece to the tray using an adhesive;
wherein said tray is attached to a support base and wherein said support base is in turn attached to an alignment and a linear motion stage wherein the alignment and linear motion stage is capable of moving in a horizontal direction;
installing a polishing pad on a polishing tool;
attaching the polishing tool on a rotating shaft;
attaching the rotating shaft to a motor installed on a vertical motion platform;
wherein said vertical motion platform is disposed above the workpiece removably mounted to the tray;
beginning the rotation of the polishing tool;
lowering the polishing tool to the workpiece;
contacting the rotating polishing pad with regions of workpiece surfaces;
moving the linear motion stage and the vertical motion platform to polish the regions of the workpiece;
detecting the surface profile of the workpiece;
ceasing the rotation of the polishing pad upon detection of a smooth surface on the workpiece;
raising of the vertical platform and the polishing tool; and
removing of the workpiece, wherein contact-less measurements are made to determine when polishing is completed.

2. The method of claim 1 further comprising introducing a slurry during the step of contacting the rotating polishing tool with the workpiece.

3. The method of claim 2 wherein said slurry is drained into a waste container in communication with the workpiece tray.

4. The method of claim 1 wherein said workpiece comprises a channel-cut crystal.

5. The method of claim 1 wherein said attaching of the polishing tool on a rotating shaft comprises use of a swiveling head to attach the polishing tool to the rotating shaft.

6. The method of claim 1 wherein said motion of the linear motion stage and the motion of the vertical motion platform is controlled by a computer.

7. The method of claim 1 wherein motion of the linear motion stage is controlled independently of the motion of the vertical motion platform.

8. The method of claim 1 wherein said polishing disk is selected to minimize its deflection during polishing.

9. The method of claim 1 wherein said rotation speed is controlled using a controller.

10. The method of claim 1 wherein the contact-less measurements occur prior to lowering the polishing tool to the workpiece and comprise an iterative process whereby a surface profile topographical map of the workpiece is generated, then the polishing tool performs one or more passes, and then another topographical map is generated.

11. The method as recited in claim 10 wherein the iterative process creates data on an unpolished surface of the workpiece, data on a simulated polished surface, and data on a polished surface.

12. The method as recited in claim 11 wherein the data is fed to an algorithm which provides guidance as to when the polishing tool should be used and the duration of polishing.

13. A method of polishing of a workpiece comprising:
placing the workpiece on a tray;
removably mounting the workpiece to the tray using an adhesive;
wherein said tray is attached to a support base and wherein said support base is in turn attached to an alignment and linear motion stage wherein the alignment and linear motion stage is capable of moving to in a horizontal direction;
installing a polishing pad on a polishing tool;
attaching the polishing tool on a rotating shaft;
attaching the rotating shaft to a motor installed on a vertical motion platform;
wherein said vertical motion platform is disposed above the workpiece reversibly attached to the tray;
beginning the rotation of the polishing tool;
lowering the polishing tool to the workpiece;
contacting the rotating polishing pad with regions of workpiece surfaces;
moving the linear motion stage and the vertical motion platform to polish the regions of the workpiece;
detecting the surface profile of the workpiece;
ceasing the rotation of the polishing pad upon detection of a smooth surface on the workpiece;
raising of the vertical platform and the polishing tool; and
removing of the workpiece
further comprising attaching at least one outrigger block to said tray containing the workpiece at the beginning of the process.

14. The method as recited in claim 13 further comprising introducing a slurry during the step of contacting the rotating polishing tool with the workpiece.

15. The method as recited in claim 14 wherein said slurry is drained into a waste container in communication with the workpiece tray.

16. The method as recited in claim 13 wherein said motion of the alignment and linear motion stage and the motion of the vertical motion platform is controlled by a computer.

17. The method as recited in claim 13 wherein motion of the alignment and linear motion stage is controlled independently of the motion of the vertical motion platform.

18. The method as recited in claim 13 wherein said workpiece comprises a channel-cut crystal.

19. The method as recited in claim 13 wherein the polishing disk is selected to minimize its deflection during polishing.

20. The method as recited in claim 13 wherein said motion of the linear motion stage and the motion of the vertical motion platform is controlled by a computer.

* * * * *